US011427878B2

(12) United States Patent
Deng et al.

(10) Patent No.: US 11,427,878 B2
(45) Date of Patent: Aug. 30, 2022

(54) ULTRAHIGH-STRENGTH ULTRAHIGH-TOUGHNESS AND LOW-DENSITY DUAL-PHASE LAMELLAR STEEL PLATE AND PREPARATION METHOD THEREFOR

(71) Applicant: Northeastern University, Shenyang (CN)

(72) Inventors: Xiangtao Deng, Shenyang (CN); Zhaodong Wang, Shenyang (CN); Hao Wu, Shenyang (CN); Tianliang Fu, Shenyang (CN); Yong Tian, Shenyang (CN); Jiadong Li, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 177 days.

(21) Appl. No.: 16/897,950

(22) Filed: Jun. 10, 2020

(65) Prior Publication Data

US 2021/0108279 A1 Apr. 15, 2021

(30) Foreign Application Priority Data

Oct. 12, 2019 (CN) ..... 201910971057.9

(51) Int. Cl.

| | |
|---|---|
| ***C22C 38/04*** | (2006.01) |
| ***C21D 8/02*** | (2006.01) |
| ***C21D 1/02*** | (2006.01) |
| ***C21D 1/18*** | (2006.01) |
| ***C22C 38/02*** | (2006.01) |
| ***C22C 38/06*** | (2006.01) |
| ***C22C 38/08*** | (2006.01) |
| ***C22C 38/20*** | (2006.01) |
| ***C22C 38/22*** | (2006.01) |
| ***C22C 38/24*** | (2006.01) |
| ***C22C 38/32*** | (2006.01) |

(52) U.S. Cl.

CPC ..... *C21D 8/0205* (2013.01); *C21D 1/02* (2013.01); *C21D 1/18* (2013.01); *C21D 8/0226* (2013.01); *C22C 38/02* (2013.01); *C22C 38/04* (2013.01); *C22C 38/06* (2013.01); *C22C 38/08* (2013.01); *C22C 38/20* (2013.01); *C22C 38/22* (2013.01); *C22C 38/24* (2013.01); *C22C 38/32* (2013.01); *C21D 2211/005* (2013.01); *C21D 2211/008* (2013.01)

(58) Field of Classification Search

CPC ..... C21D 2211/008

See application file for complete search history.

(56) References Cited

U.S. PATENT DOCUMENTS

2019/0185954 A1* 6/2019 Kohsaka ..... C21D 8/0205

FOREIGN PATENT DOCUMENTS

WO WO-2018043453 A1 * 3/2018 ..... B32B 15/013

* cited by examiner

*Primary Examiner* — Jophy S. Koshy

(74) *Attorney, Agent, or Firm* — Muncy, Geissler, Olds & Lowe, P.C.

(57) ABSTRACT

An ultrahigh-strength ultrahigh-toughness and low-density dual-phase lamellar steel plate is disclosed. The steel plate comprises the following alloy components in percentage by mass: 0.200-0.320% of C, 0.600-2.000% of Mn, 0.200-0.600% of Si, 2.000-4.000% of Al, 0.300-1.200% of Ni, 0.001-0.005% of B, P not greater than 0.012%, S not greater than 0.005%, and the balance of Fe and inevitable impurities. The steel plate consists of dual phases of ferrites and martensites, the ferrites are high-temperature delta ferrites, the martensites are lath martensites, the delta ferrites are distributed in the lath martensites in a lamellar mode. The steel plate has excellent mechanical properties, for example, the yield strength in the rolling direction is not less than 1000 MPa, the tensile strength is not less than 1600 MPa, the elongation is not less than 8.0%, and the average value of Charpy V-Notch impact energy at −40° C. is not less than 350J.

2 Claims, 4 Drawing Sheets

ULTRAHIGH-STRENGTH ULTRAHIGH-TOUGHNESS AND LOW-DENSITY DUAL-PHASE LAMELLAR STEEL PLATE AND PREPARATION METHOD THEREFOR

TECHNICAL FIELD

The present invention relates to the technical field of steel plate materials, and specifically relates to an ultrahigh-strength ultrahigh-toughness and low-density dual-phase lamellar steel plate and a preparation method therefor.

BACKGROUND

Realizing the light weight of modern transportation, marine equipment, aerospace and other high-end equipment is an important part of realizing low-carbon green sustainable development. Taking the automobile industry as an example, research shows that the fuel consumption of an automobile has a linear relationship with self weight thereof. In the case of keeping other conditions unchanged, for every 10% reduction in self weight of the automobile, fuel consumption can be reduced by 6% to 8%, thereby effectively saving energy; and for every 1 L of reduction in fuel consumption, 2.45 kg of $CO_2$ can be reduced in emission, and then the pollution of automobile exhaust to the environment can also be reduced. Light weight of equipment can be realized by increasing material strength and reducing density. For the traditional steel material mainly based on equiaxed grains, with the gradual increase in the strength of the material, the impact toughness may be reduced somewhat, affecting the performance of the material. Therefore, the development of a new material with the characteristics of low density, ultrahigh strength and high toughness is an effective way to achieve light weight of equipment.

The lamellar composite material prepared by rolling, welding and other processes has the advantages of ultrahigh strength, high impact toughness and low density, but has the disadvantages of complex preparation process and high costs, limiting the wide application thereof.

Based on the above situation, in the field of equipment manufacturing and the like in the future, there is a urgent need for steel with low density, ultrahigh strength and toughness and other comprehensive performance, and the development of related types of steel is also feasible. In order to achieve green development and high-performance product development in the field of materials, and to achieve green and sustainable development, there is a need to develop an ultrahigh-strength, ultrahigh-toughness and low density dual-phase lamellar steel plate.

SUMMARY

(I) Technical Problem to Be Solved

To solve the above problem in the prior art, the present invention provides an ultrahigh-strength ultrahigh-toughness and low-density dual-phase lamellar steel plate and a preparation method therefor, to obtain a ferrite+martensite two-phase lamellar structure of, so that the steel plate has the advantages of excellent low temperature impact toughness, as well as ultrahigh strength, low density and corrosion resistance.

(II) Technical Solution

To achieve the above purpose, the present invention adopts the following technical solution:

On the one hand, the present invention provides an ultrahigh-strength ultrahigh-toughness and low-density dual-phase lamellar steel plate, the steel plate comprising the following alloy components in percentage by mass:

0.200-0.320% of C, 0.600-2.000% of Mn, 0.200-0.600% of Si, 2.000-4.000% of Al, 0.300-1.200% of Ni, 0.001-0.005% of B, P not greater than 0.012%, S not greater than 0.005%, and the balance of Fe and inevitable impurities; the inevitable impurities comprise H, N, wherein H is not greater than 2.0 ppm, and N is not greater than 45 ppm;

the steel plate consists of dual phases of ferrites and martensites, the ferrites are high-temperature delta ferrites, the martensites are lath martensites, the delta ferrites are distributed in the lath martensites in a lamellar mode; and the volume fraction of the ferrites is not greater than 30%.

As a preferred embodiment of the present invention, the mass fraction of C, Mn and Al elements in the steel plate should satisfy: $6[C]+0.8[Mn]+1\geq[Al]$. In the case where this condition is satisfied, it can be guaranteed that at the finishing rolling temperature, the volume fraction of austenite in the steel plate is not less than 70%, so that the content of ferrite in the finished steel plate is less than 30% at room temperature after quenching.

As a preferred embodiment of the present invention, the steel plate further comprises Cr, Mo, V and Cu, and the content of the elements in the steel plate should satisfy: $Cr\leq0.700\%$, $Mo\leq0.600\%$, $V\leq0.0500\%$, and $Cu\leq1.000\%$. By adding a small amount of Cr, Mo, V, Cu to replace part of Fe, the performance of the steel plate can be further improved.

The effects of several main alloy elements in the steel plate and influence thereof on the performance of the steel plate are as follows:

Carbon: C, as an important solute element in steel, plays a role of solid solution strengthening, and can form carbides together with Fe, Mn, Mo, V and other alloy elements in steel, affect the recrystallization temperature of austenite in steel, and improve the strength of steel. Meanwhile, since C is used as an element that stabilizes austenite, the content of C has a great influence on the volume fraction of martensite in the sample at the ambient temperature, under the same component and process, the higher the content of C in the sample, the higher the volume fraction of martensite in steel at the ambient temperature. However, when the content of C in steel is too high, the welding performance of steel decreases, so the content of C in the present invention should satisfy 0.200-0.320%.

Manganese: Mn element, as an austenite stabilizing element, can expand the austenite phase area, adjust the volume fraction of austenite in the steel within the two-phase area temperature range, and improve the strength and hardness of steel. When the content of Mn element is too high, segregation is likely to occur during the smelting process, and the welding performance of steel is reduced, affecting the quality of steel. Therefore, in the present invention, the mass fraction of Mn element should satisfy 0.60-1.000%.

Aluminum: the added Al element can play a role of stabilizing ferrite in steel, expand the ferrite phase area, form stable delta ferrite, and make the steel be in the austenite+ferrite two-phase area at a high temperature. After rolling and heat treatment, this type of ferrite may be retained, which is beneficial to forming a lamellar ferrite structure in the subsequent rolling process, thereby improving the low-temperature impact toughness of the ultrahigh-strength steel plate. Meanwhile, Al element, as a light-weight alloy element, can effectively reduce the density of steel, play a role of light-weighting material, and improve the corrosion resistance of steel. In addition, a certain amount of Al element added to steel can be combined with the Ni element in steel during the preparation process to form fine and dispersed AlNi precipitates, so as to achieve the purpose of improving the strength of the steel plate without losing the toughness thereof. If the content of Al element in steel is too high, κ carbides may be generated, affecting the performance of the material. Meanwhile, if the content of Al element is too high, decarburization is likely to occur during homogenization of steel, affecting the quality of steel. In order to guarantee that the volume fraction of delta ferrite in steel is not greater than 30% at the ambient temperature, the content of C and Mn elements should be appropriately increased while increasing the Al element. Therefore, the mass fraction of Al element in the present invention should satisfy 2.000-4.000%.

In addition, Ni element in steel can improve the hardenability of steel, expand the austenite phase area, and improve the low-temperature toughness; and Mo element and V element can play the role of refining grains and improving the strength of steel.

On the other hand, the present invention provides a preparation method for the ultrahigh-strength ultrahigh-toughness and low-density dual-phase lamellar steel plate, comprising the following steps:

S1: smelting and forging: performing melting, continuous casting or ingot casting on corresponding raw materials according to preset alloy components, and preparing same into billets, wherein the preset alloy components are the alloy components of the ultrahigh-strength ultrahigh-toughness and low-density dual-phase lamellar steel plate of any one above-mentioned;

S2: rolling: thermally insulating at 1200±50° C. for 60-300 min to homogenize the billets, and then performing high-temperature rolling;

wherein the high-temperature rolling process comprises: controlling the starting rolling temperature of the billets to be 1200-1000° C., and controlling the finishing rolling temperature to be 1100-900° C., the rolling process to be not less than 7 passes, and the pass reduction to be not less than 10%; and S3: quenching: after high-temperature rolling, cooling to the ambient temperature at a cooling rate greater than 15° C./s, the final thickness of the finished steel plate being not greater than 60 mm.

In step S3, the steel plate is prepared using an on-line quenching process, the final state is a quenching state, the quenching temperature is a finishing rolling temperature of the sample, the finished steel plate is in the quenching state, and there is no need of tempering and subsequent heat treatment.

As a preferred embodiment of the present invention, in step S3, after high-temperature rolling and before on-line quenching, it should be guaranteed that the volume fraction of delta ferrites in the steel plate is not greater than 30%. In this way, after quenching, it can be guaranteed that the volume fraction of martensite in the sample at the ambient temperature is greater than 70%, so that the steel plate has high strength, hardness, elongation and impact toughness.

As a preferred embodiment of the present invention, in step S3, the structure of the finished steel plate is a dual-phase lamellar structure of delta ferrites+martensites, wherein the volume fraction of the delta ferrites is not greater than 30%.

In the present invention, an Al alloy component design performed on steel is mainly based, a high-temperature two-phase area rolling deformation process is adopted, on-line quenching is performed after rolling to quench the steel plate to the ambient temperature, and a ferrite+martensite two-phase structure is obtained at the ambient temperature, so that the steel plate has excellent mechanical properties: the yield strength in the rolling direction is not less than 1000 MPa, the tensile strength is not less than 1600 MPa, the elongation is not less than 8.0%, and the average value of Charpy V-Notch impact energy at −40° C. is not less than 350 J.

In the present invention, the mass fraction of Al element in the steel plate can be up to 4%. Compared with the traditional martensitic steel, the weight loss can be up to 5%. The prepared steel plate of the present invention has the advantages of excellent low-temperature impact toughness, as well as ultrahigh strength, low density and corrosion resistance.

In the preparation method of the present invention, the temperature range of "high-temperature rolling" of the steel plate is in the "ferrite+austenite" two-phase area in the Fe—C alloy phase diagram. Within the temperature range corresponding to the two-phase area, the structure of the steel plate during rolling deformation is a ferrite+austenitet two-phase structure, and the volume fraction of ferrite is not greater than 30%. After two-phase area rolling and quenching, the obtained finished steel plate also has a two-phase lamellar structure.

(III) Advantageous Effects

The present invention has the following advantageous effects:

The present invention has the characteristics that the ferrite phase area is expanded by adding the Al element, rolling deformation of the billet in the "ferrite+austenite" two-phase area is realized, and it is known according to the calculation of Thermo-calc software that there are a ferrite phase and an austenite phases in steel within the temperature range of hot rolling deformation of the steel plate. Two-phase area rolling and on-line quenching are performed on the steel plate, the lamellar structure obtained by rolling deformation is retained to the ambient temperature state, and a delta ferrite+martensite two-phase lamellar structure is obtained at the ambient temperature, so that the steel plate has good strength and toughness.

In the present invention, an Al alloy component design is performed based on conventional martensite micro alloyed steel, the content of Mn in the steel is made relatively low, high-temperature rolling and on-line quenching are performed on the alloyed steel at two-phase area (ferrite+austenite two-phase area) temperature, so a ferrite+martensite dual-phase structure distributed in a lamellar mode can be obtained while obtaining low density, the lamellar direction is parallel to the rolling direction, so the steel can have the advantages of ultrahigh strength and ultrahigh toughness, simple preparation process and low costs.

In the preparation method of the present invention, a high-temperature two-phase area (ferrite+austenite two-phase area) rolling deformation process is adopted, the steel plate is quenched to an ambient temperature on line after rolling, and a lamellar structure obtained by rolling deformation is retained to the ambient temperature state, and a ferrite+martensite two-phase structure is obtained at the ambient temperature, so that the steel plate has excellent mechanical properties, for example, the yield strength in the rolling direction is not less than 1000 MPa, the tensile strength is not less than 1600 MPa, the elongation is not less than 8.0%, and the average value of Charpy V-Notch impact energy at −40° C. is not less than 350 J.

DETAILED DESCRIPTION

In specific examples of the present invention, the topography of the sample is characterized by observing the microstructure topography of the sample and combining with the scanning electron microscope. To describe the present invention more clearly, the present invention is further described below in combination with the preferred embodiments. The content described below is illustrative rather than restrictive, and should not be used to limit the scope of the present invention.

Embodiment 1

The steel plate of this embodiment is smelted, and the alloy components (mass percentage) of the steel plate are designed as shown in Table 1.

TABLE 1

| C | Si | Mn | Al | Ni | B | P | S | Fe |
|---|---|---|---|---|---|---|---|---|
| 0.200 | 0.220 | 0.600 | 2.000 | 0.800 | 0.002 | 0.005 | 0.001 | Balance |

The alloy components satisfy: 6[C]+0.8[Mn]+1≥[Al].

A corresponding raw material is smelted and cast into a strand according to the optimal alloy components, and the strand is heated to 1200° C. and thermally insulated, is forged into a billet with a thickness of 100 mm, and is air cooled to the ambient temperature after forging.

The forged billet with a thickness of 100 mm is heated to 1200° C. and thermally isolated for 60 minutes for homogenization, then is subjected to 7-pass rolling, wherein the starting rolling temperature is 1086° C., the thickness of the rolled steel plate is 12 mm, the total reduction is 88%, the finishing rolling temperature is 1033° C., and the steel plate is quenched to the ambient temperature at a cooling rate greater than 15° C./s after rolling.

Figure 3:
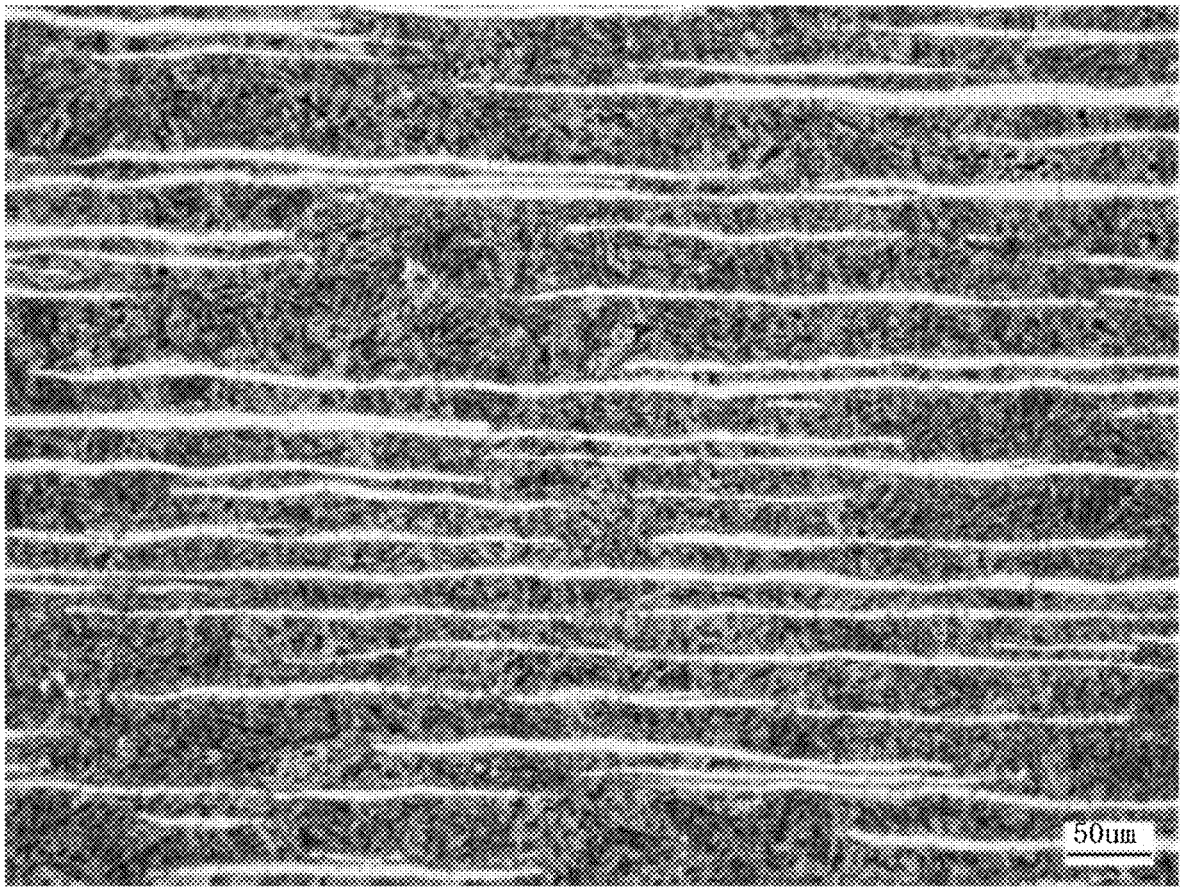
FIG. 3 is a schematic diagram showing a metallographic structure of steel obtained under the preparation process condition in embodiment 2.

The mechanical properties of the final steel plate are shown in Table 2. The yield strength in the rolling direction is 1064 MPa, the tensile strength is 1658 MPa, the elongation after breaking is 10.4%, and the average value of Charpy V-Notch impact energy at −40° C. is 415.6 J. The microcosmic metallographic structure of the steel plate obtained in embodiment 1 is as shown in FIG. 3, in which the black structure is martensite, the white structure is ferrite, and the two phases are distributed in a lamellar mode.

Figure 1:
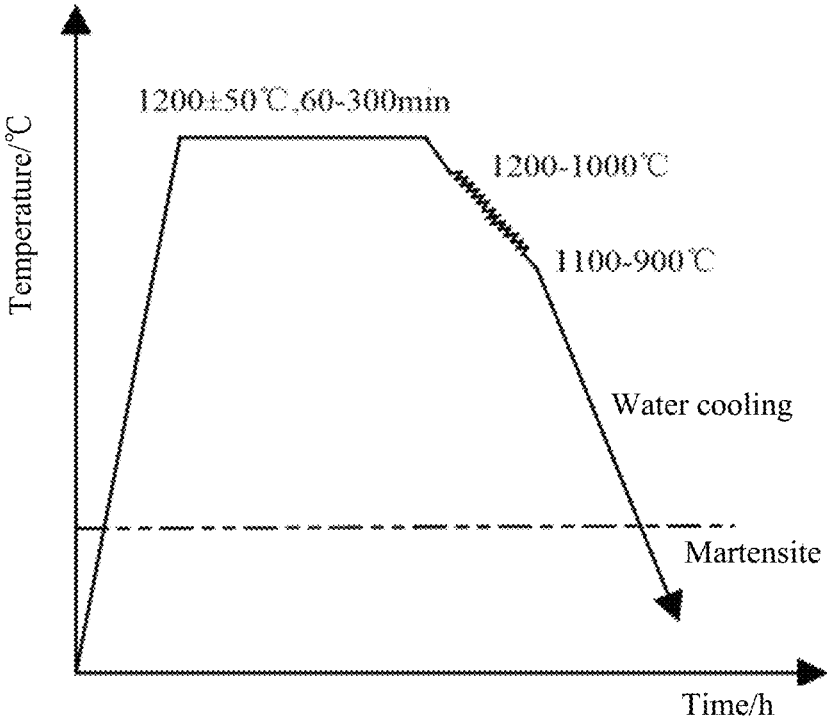
FIG. 1 is a schematic diagram showing rolling and on-line heat treatment process of steel of the present invention.
Figure 2:
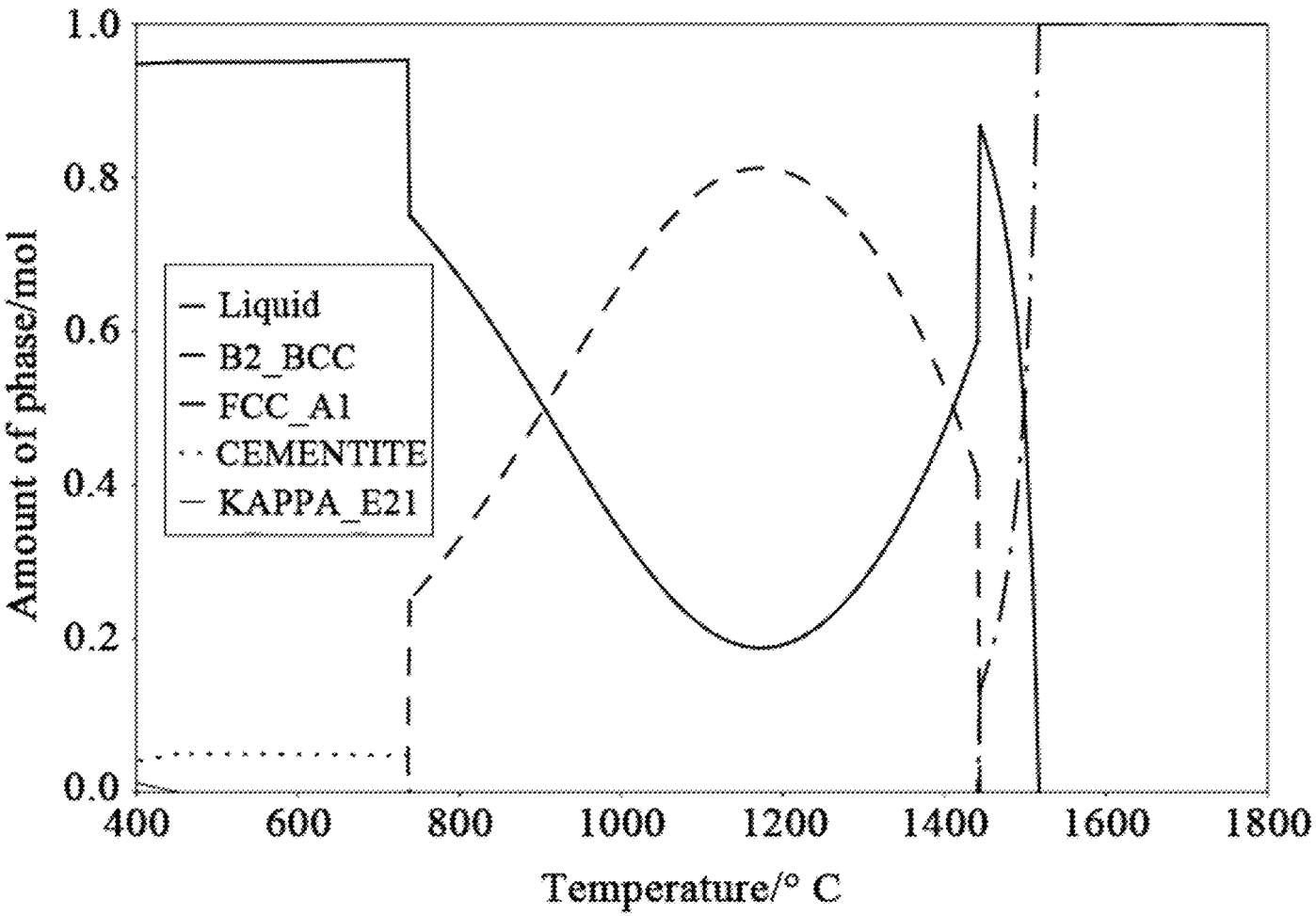
FIG. 2 is a diagram showing properties of a steel plate with selected components in embodiment 1 of the present invention calculated using Thermo-calc software.

Properties of the steel plate in embodiment 1 calculated using Thermo-calc software are shown in FIG. 2.

Table 2 shows mechanical properties of a steel plate sample obtained in embodiment 1.

TABLE 2

| Density | Yield Strength | Tensile Strength | Elongation After | −40° C. Impact energy |
|---|---|---|---|---|
| 7.66 | 1064 | 1658 | 10.4 | 415.6 |

Embodiment 2

The steel plate of this embodiment is smelted, and the alloy components (mass percentage) of the steel plate are designed as shown in Table 3.

TABLE 3

| C | Si | Mn | Al | Ni | B | P | S | Fe |
|---|---|---|---|---|---|---|---|---|
| 0.260 | 0.220 | 1.000 | 3.000 | 0.800 | 0.002 | 0.005 | 0.001 | Balance |

The alloy components satisfy: 6[C]+0.8[Mn]+1≥[Al].

A corresponding raw material is smelted and cast into a strand according to the optimal alloy components, and the strand is heated to 1200° C. and thermally insulated, is forged into a billet with a thickness of 100 mm, and is air cooled to the ambient temperature after forging.

The forged billet with a thickness of 100 mm is heated to 1200° C. and thermally isolated for 60 minutes for homogenization, then is subjected to 7-pass rolling, wherein the starting rolling temperature is 1086° C., the thickness of the rolled steel plate is 12 mm, the total reduction is 88%, the finishing rolling temperature is 1042° C., and the steel plate is quenched to the ambient temperature at a cooling rate greater than 15° C./s after rolling.

The mechanical properties of the final steel plate are shown in Table 4. The yield strength in the rolling direction is 1158 MPa, the tensile strength is 1764 MPa, the elongation after breaking is 8.9%, and the average value of Charpy V-Notch impact energy at −40° C. is 382.4 J.

Figure 4:
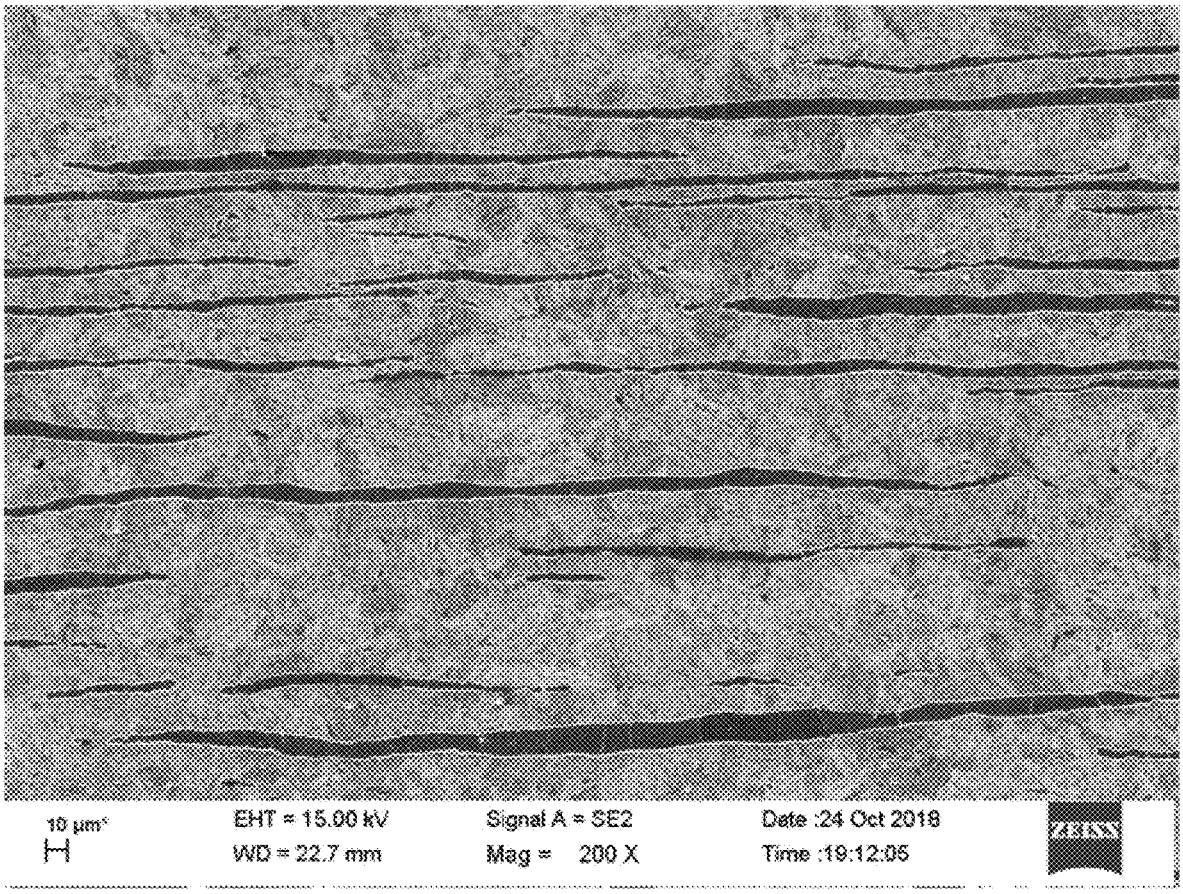
FIG. 4 is a schematic diagram showing a scanning electron microscope structure of steel obtained under the preparation process condition in embodiment 3.

The scanning electron microscope structure of the steel plate obtained in embodiment 2 is as shown in FIG. 4, in which the convex structure is martensite, and the concave structure is ferrite.

Table 4 shows mechanical properties of a steel plate sample obtained in embodiment 2.

| Density (g/cm3) | Yield strength (MPa) | Tensile strength (MPa) | Elongation after breaking (%) | −40° C. impact energy (J) |
|---|---|---|---|---|
| 7.48 | 1158 | 1764 | 8.9 | 382.4 |

Embodiment 3

The steel plate of this embodiment is smelted using a vacuum induction furnace, and the alloy components (mass percentage) of the steel plate are designed as shown in Table 5.

TABLE 5

| C | Si | Mn | Al | Ni | B | P | S | Fe |
|---|---|---|---|---|---|---|---|---|
| 0.320 | 0.220 | 1.500 | 4.000 | 0.800 | 0.002 | 0.005 | 0.001 | Balance |

The alloy components satisfy: 6[C]+0.8[Mn]+1≥[Al].

A corresponding raw material is smelted and cast into a strand according to the optimal alloy components, and the strand is heated to 1200° C. and thermally insulated, is forged into a billet with a thickness of 100 mm, and is air cooled to the ambient temperature after forging.

The forged billet with a thickness of 100 mm is heated to 1200° C. and thermally isolated for 60 minutes for homogenization, then is subjected to 7-pass rolling, wherein the starting rolling temperature is 1086° C., the thickness of the rolled steel plate is 12 mm, the total reduction is 88%, the finishing rolling temperature is 1037° C., and the steel plate is quenched to the ambient temperature at a cooling rate greater than 15° C./s after rolling.

The mechanical properties of the final steel plate are shown in Table 6. The yield strength in the rolling direction is 1227 MPa, the tensile strength is 1851 MPa, the elongation after breaking is 8.2%, and the average value of Charpy V-Notch impact energy at −40° C. is 359.9 J. (Table 6 shows mechanical properties of a steel plate sample obtained in embodiment 3).

TABLE 6

| Density (g/cm3) | Yield strength (MPa) | Tensile strength (MPa) | Elongation after breaking (%) | −40° C. impact energy (J) |
|---|---|---|---|---|
| 7.33 | 1227 | 1851 | 8.2 | 359.9 |

The present invention has the characteristics that the ferrite phase area is expanded by adding the Al element, rolling deformation is realized at the two-phase area temperature, and it is known according to the calculation of Thermo-calc software that there are a ferrite phase and an austenite phases in steel within the temperature range of hot rolling deformation of the steel plate. Two-phase area rolling and on-line quenching are performed on the steel plate, and the lamellar structure obtained by rolling deformation is retained to the ambient temperature state, and a delta ferrite+martensite two-phase lamellar structure is obtained at ambient temperature, so that the steel plate has good strength and toughness.

It should be noted that the above description of the specific embodiments of the present invention is only for illustrating the technical route and features of the present invention, and aims to make those skilled in the art know the content of the present invention and implement same accordingly. However, the present invention is not limited to the specific embodiments. Various changes or modifications made within the scope of the present invention shall be covered in the protection scope of the present invention.

The invention claimed is:

1. A dual-phase lamellar steel plate, comprising the following alloy components in percentage by mass:

0.200-0.320% of C, 0.600-2.000% of Mn, 0.200-0.600% of Si, 2.000-4.000% of Al, 0.300-1.200% of Ni, 0.001-0.005% of B, P not greater than 0.012%, S not greater than 0.005%, Cr not more than 0.700%, and a balance of Fe and inevitable impurities; the inevitable impurities comprise H and N, wherein H is not greater than 2.0 ppm, and N is not greater than 45 ppm;

the steel plate consists of dual phases of ferrites and martensites, the ferrites are delta ferrites, the martensites are lath martensites, the delta ferrites are distributed in the lath martensites in a lamellar mode; and a volume fraction of the ferrites is not greater than 30% and is not zero.

2. The dual-phase lamellar steel plate according to claim 1, wherein a mass fraction of C, Mn and Al elements in the steel plate satisfies:

6[C]+0.8[Mn]+1≥[Al].

* * * * *